United States Patent [19]

Yoshimura et al.

[11] Patent Number: 4,996,561

[45] Date of Patent: Feb. 26, 1991

[54] IMAGE FORMING APPARATUS WITH A DOCUMENT IMAGE EDITION FUNCTION

[75] Inventors: Tsuyoshi Yoshimura, Tokyo; Takeshi Yamakawa, Fujisawa, both of Japan

[73] Assignee: Ricoh Company, Ltd., Tokyo, Japan

[21] Appl. No.: 416,484

[22] Filed: Oct. 3, 1989

[30] Foreign Application Priority Data

Oct. 5, 1988 [JP] Japan ..... 63-130731[U]

[51] Int. Cl.[5] ..... G03G 21/00

[52] U.S. Cl. ..... 355/202; 355/218

[58] Field of Search ..... 355/200, 202, 210, 218, 355/309

[56] References Cited

U.S. PATENT DOCUMENTS

| | | | |
|---|---|---|---|
| 4,707,109 | 11/1987 | Kanno et al. | 355/218 |
| 4,734,789 | 3/1988 | Smith et al. | 355/202 X |
| 4,745,491 | 5/1988 | Kishi et al. | 355/218 X |
| 4,799,080 | 1/1989 | Fujiwara | 355/218 |
| 4,812,875 | 3/1989 | Tanimoto | 355/309 X |
| 4,829,341 | 5/1989 | Sasaki et al. | 355/75 |

*Primary Examiner*—Fred L. Braun

*Attorney, Agent, or Firm*—Oblon, Spivak, McClelland, Maier & Neustadt

[57] ABSTRACT

An image forming apparatus operable with an editor which can be mounted on a body of the apparatus together with a document handler and has space for accommodating an editor is defined within the apparatus between optics including a scanner and a photoconductive element located below the optics. The editor is movable into and out of the space through an opening which is formed through the apparatus, as desired.

4 Claims, 4 Drawing Sheets

IMAGE FORMING APPARATUS WITH A DOCUMENT IMAGE EDITION FUNCTION

BACKGROUND OF THE INVENTION

The present invention relates to an image forming apparatus having a document image editing function and, more particularly, to an image forming apparatus operable with an editor for editing a document image and constructed to accommodate the editor in a body thereof as needed.

Some modern image forming apparatuses such as an electrophotographic copier, facsimile machine and printer are provided with an editing function for deleting or extracting a desired part of a document image. For example, an analog copier with an editing function has an editor which is physically independent of a body of the apparatus and operated at a spaced location. While a person edits a document image on the editor by using a light pen, for example, a signal representative of the edited image is fed to a control section of the copier body by a cable. A drawback with such a prior art analog copier is that a substantial extra space or setting the editor has to be secured in addition to a space for placing the copier body. Recently, a digital copier with an editing function has been developed which has an editor constructed integrally with a top cover or presser plate of the copier. Although this kind of copier is successful in saving space, the unitary top cover and editor assembly is not practicable when an ADF (Automatic Document Feeder), SADF (Semiautomatic Document Feeder) or similar document handler which also plays the role of a top cover is mounted on the copier.

SUMMARY OF THE INVENTION

It is therefore an object of the present invention to provide an image forming apparatus operable with an editor which can be mounted on a body of the apparatus together with a document handler.

It is an other object of the present invention to provide a generally improved image forming apparatus.

An image forming apparatus having an image carrier for carrying a latent image thereon, optics for steering an imagewise reflection from an original document to the image carrier to form a latent image, and a body accommodating the image carrier and optics of the present invention comprises a spaced defined between the optics and the image carrier, and a housing constituting the body and formed with an opening through a part thereof. An editor for editing a document image is accommodated in the body and pulled out of the body through the opening as needed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, prior art image forming apparatuses with an editing function will be outlined.

Figure 1:
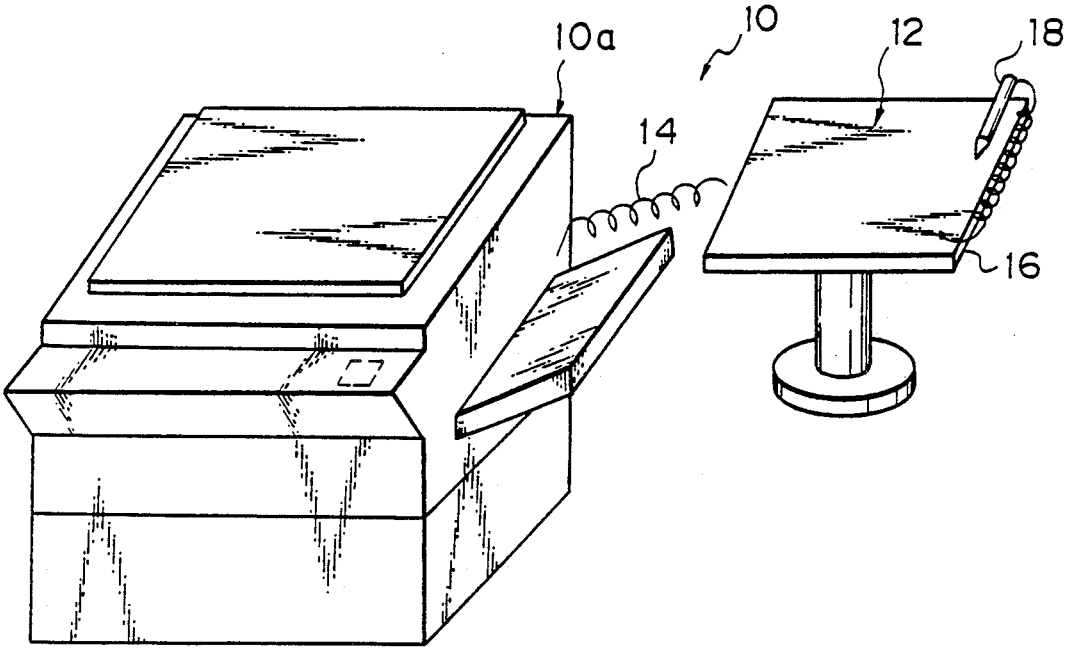
Fig. 1 PRIOR ART
FIG. 1 is a perspective view of a prior art analog copier having a document image editing function and an editor associated therewith.

FIG. 1 shows a prior art analog copier belonging to a family of image forming apparatuses with an editing function. The copier, generally 10 , has a body 10*a* and an editor 12 which are interconnected by a cable 14 for the transmission of signals. The editor 12 is mounted on a support table 16 while in use. The editor 12 has a flat surface which is greater than the maximum document size usable with the copier 10. A scale in the form of a mesh is provided on the flat surface so that one may edit a document image by using a light pen 18, for example, and by designating coordinates on the scale. A problem with this kind of analog copier 10*a* and the support table 16 which is physically independent of the copier body 10*a*. Also, the copier 10 is not satisfactory in manipulability.

Figure 2:
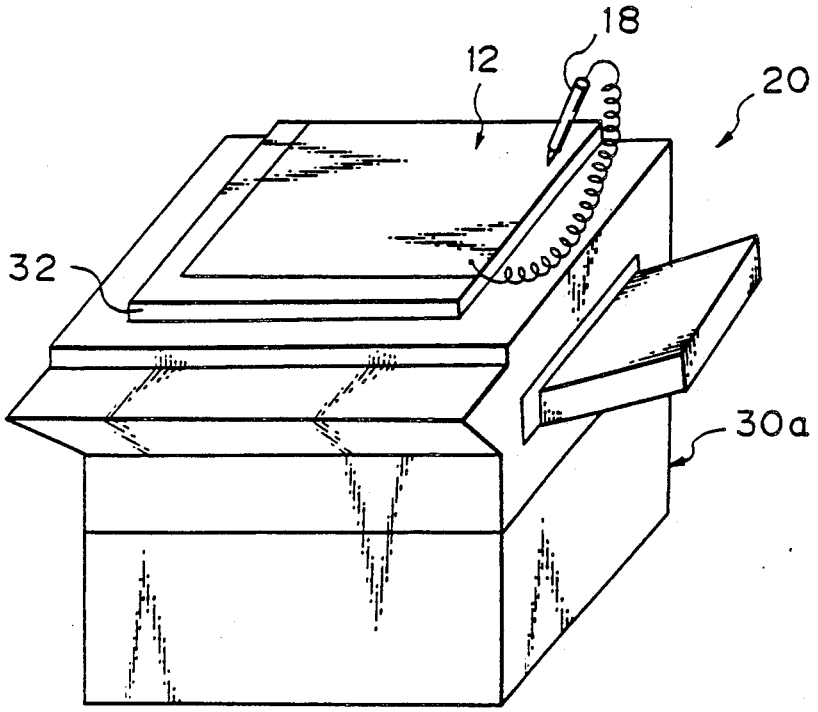
Fig. 2 PRIOR ART
FIG. 2 is a view similar to FIG. 1, showing a prior art digital copier with an editing function and an editor associated therewith.

Referring to FIG. 2 a prior art digital copier with an editing function is shown and generally designated by the reference numeral 20. As shown, the copier 20 has a body 30*a*, a top cover or presser plate 32 mounted on the top of the body 30*a*, and the editor 12 which is constructed integrally with the top cover 30*a*. This type of copier 30 effectively saves space and promotes efficient manipulations, compared to the analog copier 10 shown in FIG. 1. However, when it comes to a copier of the type having an ADF, SADF or similar document handler a part of which serves as a top cover, the editor 12 cannot be mounted on the top of the copier body 30*a* or has to be mounted on the exclusive support table 16 as with the analog copier 10 shown in FIG. 1. While the editor 12, of course, may be mounted on the top of the ADF, the applicability of this kind of configuration is limited. Specifically, in the case of an ADF of the type transporting a document from a document table to a glass platen and further to a discharge tray which is located at the opposite side of the document table, the space available above the ADF is not used and can accommodate the editor 12. However, with an ADF of the type transporting a document from a document table to a glass platen and then discharging it to the upper surface of the ADF by turning it over, it is impossible to mount the editor 12 on the top of the ADF.

A preferred embodiment of the image forming apparatus in accordance with the present invention will be described in detail with reference to the accompanying drawings.

Figure 3:
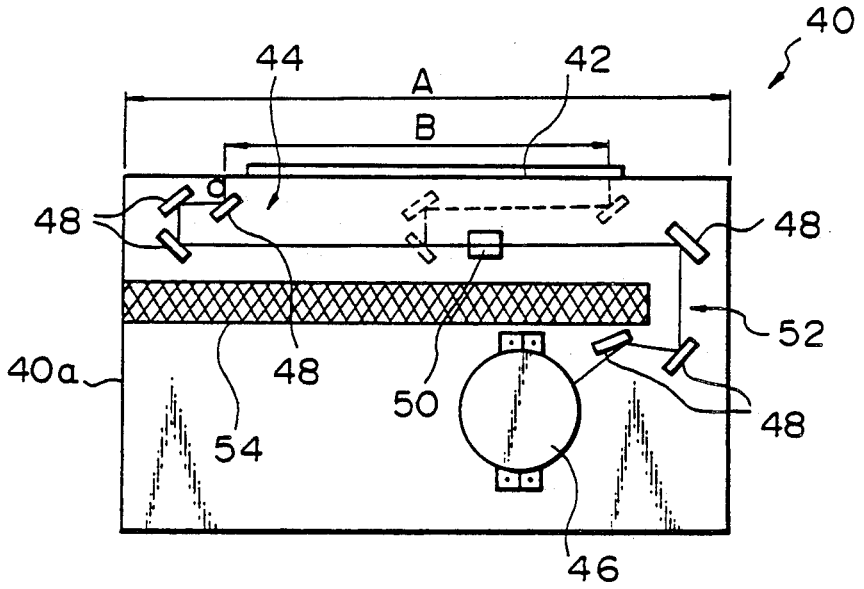
FIG. 3 is a sectional side elevation of an analog copier having an editing function to which a preferred embodiment of the image forming apparatus embodying the present invention is applied.

FIG. 3 shows an analog copier to which the embodiment of the present invention is applied. The analog copier, generally 40, has a body 40*a*, a glass platen 42 mounted on the body 40*a*, a scanner 44 for scanning the underside of the glass platen 42, an image carrier in the form of a photoconductive drum 46, a number of mirrors 48 for steering imagewise light from a document to the drum 46, and a lens 50.

In the analog copier 40 which copies a document being held stationary on the glass platen 42, the scanner 44 reciprocates over a distance B which is usually selected to be about 470 millimeters, i.e., 420 millimeters which is the lengthwise dimension of a document of format A3 plus 40 millimeters for an approach run plus 10 millimeters for an overrun. On the other hand, the copier body 40*a* had a width A which is selected to be about 600 millimeters in order to secure an optical space. Concerning an optical path extending from optics which includes the scanner 44 to the drum 46 located below the optics, its position is free to choose within the copier body 40*a* so long as an imagewise reflection from a document can reach the drum 46. Therefore, as shown in FIG. 3, when an optical path 52 is defined at one side, i.e., at the right-hand side of the copier body 40*a*, a space 54 for accommodating an editor is available as indicated by hatching. The space 54 can be dimensioned sufficiently greater than the maximum document size applicable to the copier 40.

Figure 4:
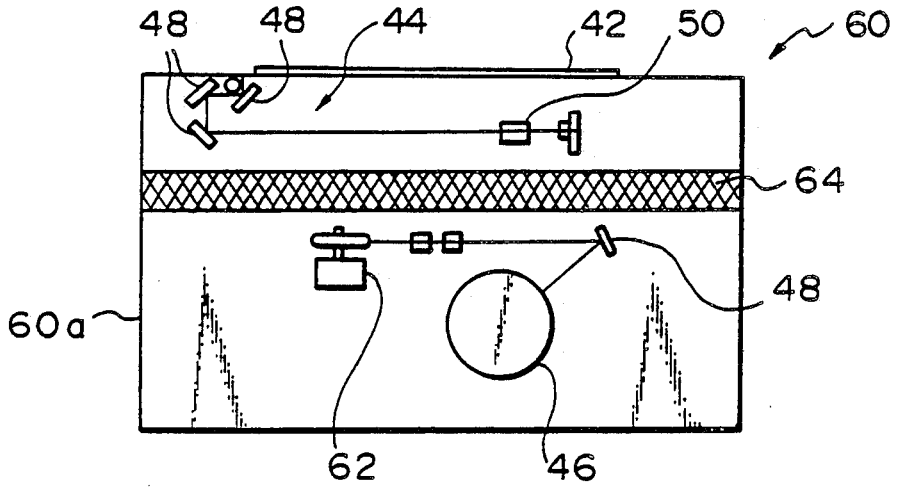
FIG. 4 is a view similar to FIG. 3, showing a digital copier having an editing function to which the illustrative embodiment is also applied.

FIG. 4 shows a digital copier to which the illustrative embodiment is also applied. The digital copier, generally 60, is of the type converting document data into an electric signal and driving a laser oscillator 62 by the electric signal to scan the drum 46. In this type of copier 60, optics and the drum 46 are associated with each other by a cable which is laid in a body 60*a* of the copier 60 and not by an optical path. Hence, a space 64 broader than the space 54 is available in the copier body 60*a* for accommodating an editor.

Figure 5A:
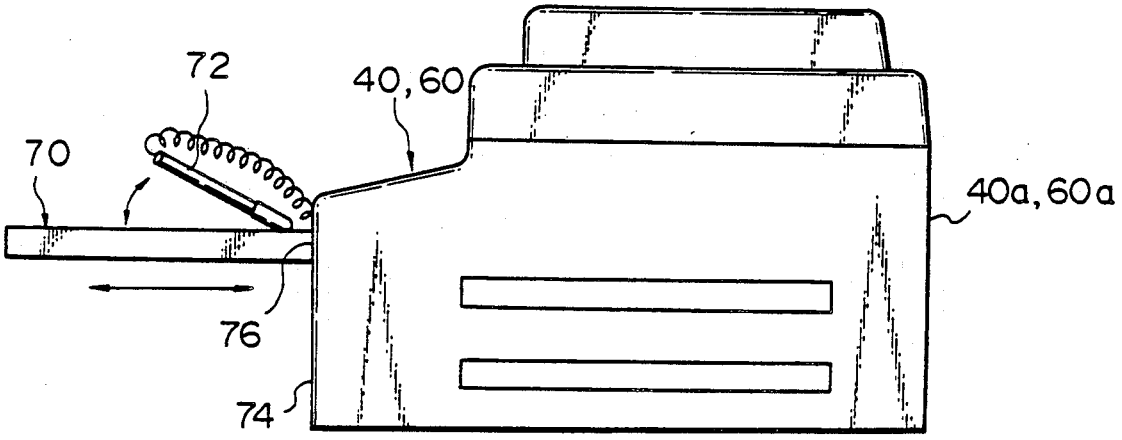
FIGS. 5A and 5B are views demonstrating how an editor included in any of the copiers shown in FIGS. 3 and 4 is moved into and out of the copier.
Figure 5B:
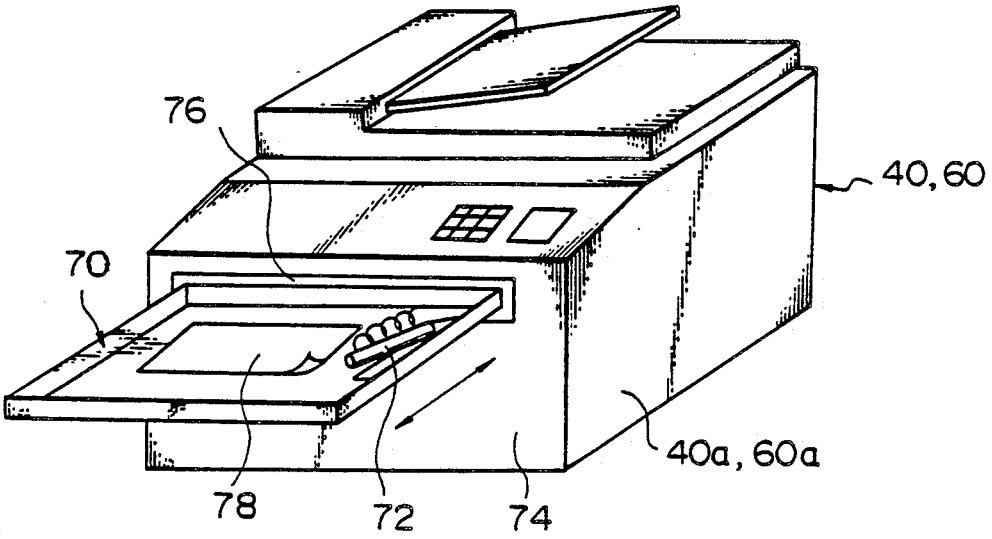

In the illustrative embodiment, an editor 70 having a flat and rigid configuration is accommodated in the space 54 or 64 and can be slidingly pulled thereout of as needed. Specifically, as shown in FIGS. 5A and 5B, the copier body 40*a* or 60*a* has an opening 76 formed through a front wall 74 thereof, while the editor 70 accommodated in the space 54 or 64 is pulled thereout of through the opening 76 together with a pen 72 as desired. Since the opening 76 is formed through the front wall 74 of the copier body 40*a* or 60*a* as stated, an operator is allowed to manipulate the editor 70 into and out of the space 54 or 64 in the front-and-rear direction of the copier 40 or 60. The editor 70 may be provided with a recess for receiving the pen 72. To use the editor 70, one pulls it out through the opening 76. Then, the operator may lay a document 78 on the editor 70, enter desired data on the editor 70, pick up the document 78 to load it on an ADF or similar document handler, and then push the editor 70 into the copier body 40*a* or 60*a*. Thereafter, when the operator presses a copy start button, the copier will produce a copy carrying an edited image thereon.

Since the editor 70 is pulled out of the copier body 40*a* or 60*a* only when editing work is needed, it does not interfere with the manipulation of the copier, especially that of an ADF. An arrangement may be made such that, while the editor 70 is held in an operative position outside of the copier body 40*a* or 60*a*, the copier body 40*a* or 60*a* recognizes that an editing mode is selected. In a copier of the kind which does not need the editor 70, the space 54 or 64 may be used to accommodate a table for stacking documents. The editor 70 may be provided as an optional unit, if desired.

Figure 6:
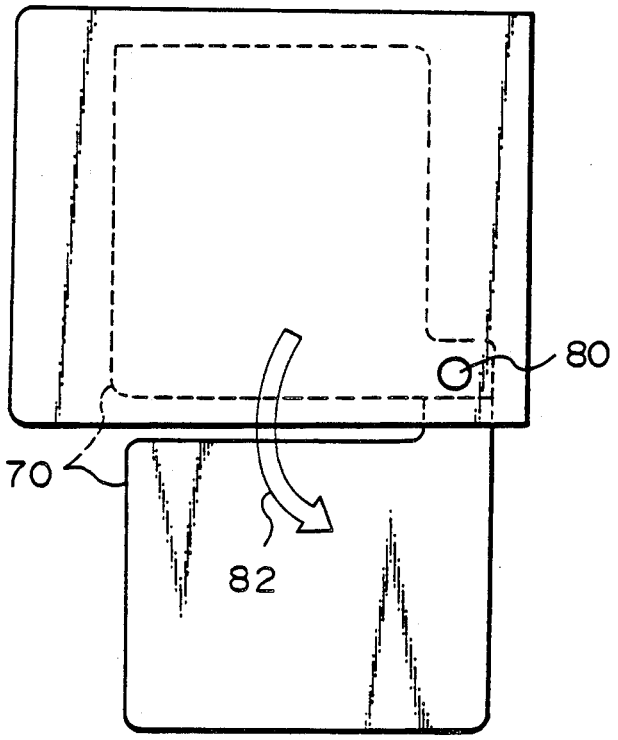
FIG. 6 is a schematic view showing an alternative mechanism available for moving the editor into and out of the copier.

FIG. 6 shows an alternative mechanism which allows the editor 70 to be moved into and out of the copier body. As shown, the mechanism is such that the editor 70 is rotatable about a pivot 80 into and out of the copier body as indicated by an arrow 82.

In summary, it will be seen that the present invention provides an image forming apparatus which saves an exclusive space heretofore needed to set an editor and allows an editor to coexist with an ADF or similar optional unit. These advantages are derived from a unique configuration wherein a space for accommodating an editor is defined between optics including a scanner and a photoconductive drum located below the optics, the editor being moved into and out of the copier as desired.

Various modifications will become possible for those skilled in the art after receiving the teachings of the present disclosure without departing from the scope thereof.

What is claimed is:

1. An image forming apparatus having an image carrier for carrying a latent image thereon, original document support means, optics for steering an imagewise reflection from an original document to said image carrier to form a latent image, and a body accommodating said image carrier and said optics, said apparatus comprising:

a space defined in said body between the optics and the image carrier and dimensioned sufficiently greater than the maximum original document size applicable to said image forming apparatus;

a housing constituting the body and formed with an opening through a part of said housing; and an editor supported so as to be insertable into, and removable from, said body via said opening for editing a document image, said editor having a substantially flat rigid surface separated from said original document support means and sufficiently greater than the maximum original document size, wherein said editor is accommodated in the space of the body and pulled out of said space through said opening as needed.

2. An apparatus as claimed in claim 1, wherein said part of said housing through which said opening is formed comprises a front wall, said editor being moved into and out of the body in a front-and-rear direction of said apparatus.

3. An apparatus as claimed in claim 1, wherein the editor is slidable into and out of the body through said opening.

4. An apparatus as claimed in claim 1, wherein the editor is rotatable into and out of the body through said opening and about a pivot which is affixed to said housing.

* * * * *